United States Patent [19]

Clipston et al.

[11] 4,177,303

[45] Dec. 4, 1979

[54] METHOD OF GALVANIZING A PORTION ONLY OF A FERROUS METAL ARTICLE

[75] Inventors: Robert H. Clipston, Hamilton; Emerson O. Hall, Burlington; Hon-Hei F. Ng, Hamilton, all of Canada

[73] Assignee: Dominion Foundries and Steel, Limited, Hamilton, Canada

[21] Appl. No.: 924,297

[22] Filed: Jul. 13, 1978

Related U.S. Application Data

[63] Continuation-in-part of Ser. No. 789,828, Apr. 22, 1977, abandoned.

[51] Int. Cl.[2] ..... B05D 1/18; B05D 1/38

[52] U.S. Cl. ..... 427/259; 106/2; 106/286.6; 106/287.1; 106/287.23; 106/287.35; 427/300; 427/433

[58] Field of Search ..... 427/259, 300, 309, 433; 106/2, 286, 287.1, 287.23, 287.35; 252/79.1; 134/41; 260/542

[56] References Cited

U.S. PATENT DOCUMENTS

| | | | |
|---|---|---|---|
| 1,334,092 | 3/1920 | Harmeling | 134/41 X |
| 2,894,850 | 7/1959 | Greene et al. | 117/5.5 |
| 3,089,780 | 5/1963 | Sipk | 117/5.5 |
| 3,104,993 | 9/1963 | Sievert et al. | 148/6.15 |
| 3,121,019 | 2/1964 | Blay | 117/5.5 |
| 3,149,987 | 9/1964 | Crandall | 117/5.5 |
| 3,177,085 | 4/1965 | Adams | 117/5.5 |
| 3,178,321 | 4/1965 | Satterfield | 106/287.5 X |
| 3,181,963 | 5/1965 | Cook et al. | 117/5.5 |
| 3,398,010 | 8/1968 | Harvey et al. | 427/300 |

FOREIGN PATENT DOCUMENTS 1241013 of 1971 United Kingdom ..... 427/259

OTHER PUBLICATIONS

Grant, J. (editor), *Hackh's Chemical Dictionary*, 4th Ed., McGraw-Hill Book Co., New York City, N.Y., p. 277.

*Primary Examiner*—Evan K. Lawrence
*Attorney, Agent, or Firm*—Hirons, Rogers & Scott

[57] ABSTRACT

In a method of galvanizing a portion only of a ferrous metal article, in particular for galvanizing one side only of a thin flat ferrous metal strip, the material used for forming a protective coating on the part of the article not to be galvanized is a suspension comprising a liquid suspending vehicle consisting of water and from 5 to 20% by weight, preferably from 6 to 16%, of the powdered hydrated form of magnesium silicate known as talc. The suspension preferably also includes a bonding or etching agent to increase the adherence of the coating to the article, a wetting agent to facilitate spreading of the coating, a thickener to facilitate the suspension of the powdered material and a defoamer if necessary.

25 Claims, 1 Drawing Figure

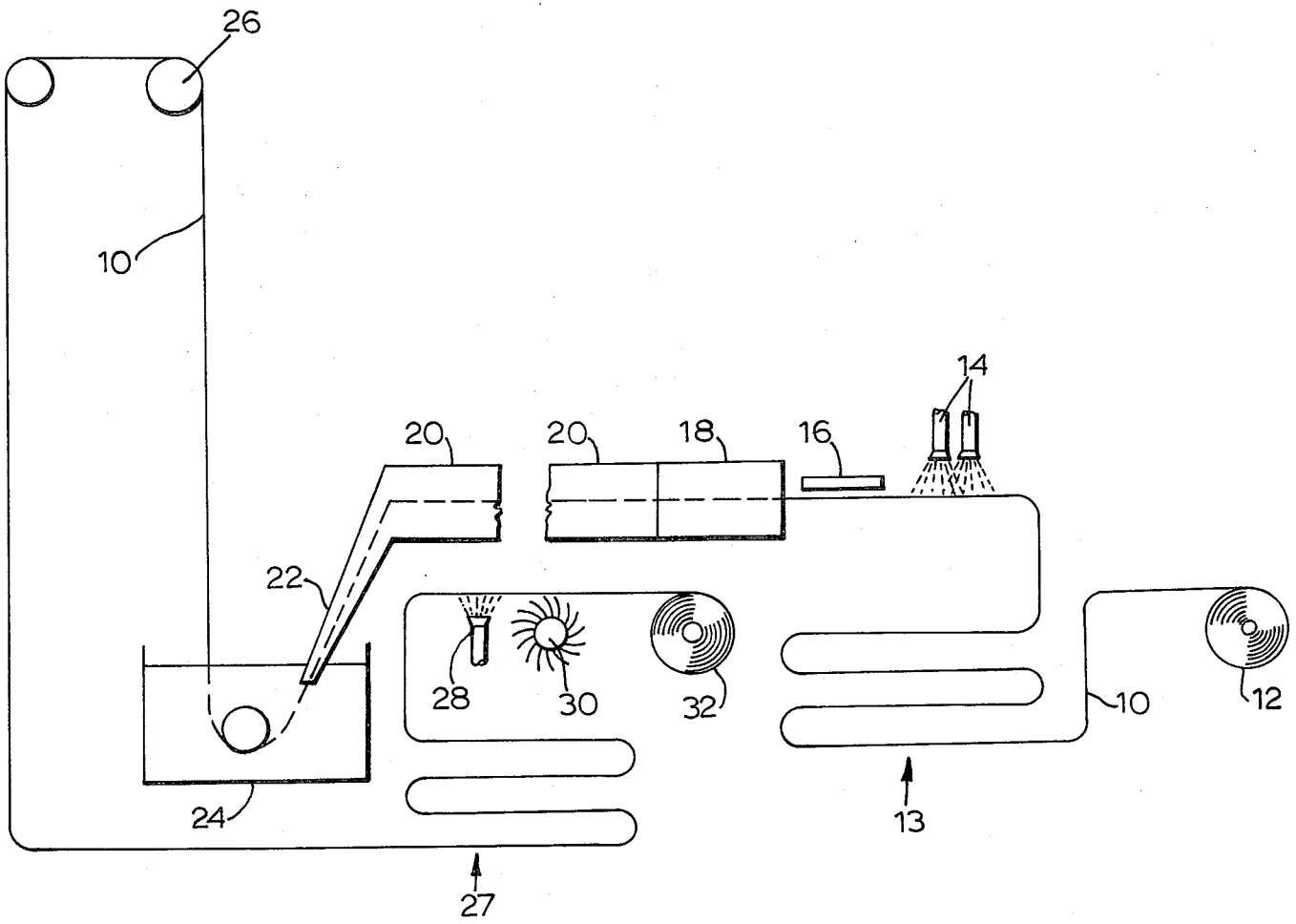
26
10
22
20
20
18
16
14
28
30
32
12
10
24
27
13

METHOD OF GALVANIZING A PORTION ONLY OF A FERROUS METAL ARTICLE

CROSS-REFERENCE TO RELATED APPLICATION

This application is a continuation-in-part of our application Ser. No: 789,828 filed Apr. 22, 1977, now abandoned.

FIELD OF THE INVENTION

The present invention relates to a method of galvanizing a portion only of a ferrous metal article, and especially to a method of one-side galvanizing of a thin flat ferrous metal strip.

REVIEW OF THE PRIOR ART

Numerous processes have been proposed hitherto for one-side galvanizing of ferrous metal strip, in view of the requirements by automobile makers for such material. Thus they have a need for a sheet steel which is zinc-coated on the side that becomes the interior surface, so as to provide needed protection against corrosion, while the other exterior side is uncoated for maximum weldability and surface finishing by conventional painting treatments.

As typical examples of prior art processes may be mentioned those disclosed in U.S. Pat. Nos: 2,894,850; 3,089,780; 3,121,019; 3,177,085; 3,181,963 and 3,398,010. All of these processes include the basic steps of applying a protective coating to one surface of the thin flat strip, galvanizing the thus-coated strip to coat the other surface with zinc, and then removing the protective coating to reveal the bare metal of the respective surface.

The principal requirements for the coating material are that it should be easy to apply, preferably at ambient temperature and without extensive preparation of the strip, as economical as possible in cost, while of course giving complete coverage and adhering under the relatively severe conditions of immersion in the galvanizing bath and passage through the hot, highly reducing atmosphere of an annealing furnace, if employed. The materials must not contaminate the zinc bath and must be easy to remove from the protected surface, and so that upon removal the exposed metal surface is still receptive of the required surface finish, at least as well as the original metal.

There is disclsed in U.S. Pat. No: 3,178,321 (Armco Steel) a coating material intended to protect the surface of metal against excessive scaling and other attack during handling and heat treating of such metal. This specification is not at all concerned with the special problem of attack through a protective coating by molten zinc in the course of a galvanizing treatment. At column 3, lines 30 to 44, the specification sets out the materials which can be used, and these are specially prepared oxides, silicates, chromates and molybdates; certain naturally occurring materials may be employed in substitution in whole or in part for the more refined forms previously mentioned. As illustrations of these naturally-occurring materials the specification mentions clay, kaolin, asbestos, bentonite, talc, pyrophyllites and the like. This is the only reference in the specification to the possible use of talc. The specification includes specific examples of protective coating formulations, in which kaolin, velva clay, and asbestos are proposed as constituents, but only in combination with colloidal silica. Moreover, the vehicle for these proposed solid constituents consists of a mixture of more alcohol than water, together with an organic bonding resin.

SUMMARY OF THE INVENTION

It is therefore an object of the invention to provide a new method for galvanizing a part only of a ferrous metal article employing a new aqueous suspension that is readily applied and is removable by washing and brushing from the surface of the article.

In accordance with the present invention there is provided a method of galvanizing a portion only of a ferrous metal article, such as one surface of a ferrous metal strip, including the steps of:

applying to the portion of the article that is not to be galvanized a suspension comprising a liquid suspending vehicle consisting of water and from 5 to 20% by weight of the suspension of the hydrated form of magnesium silicate known as talc suspended in the water and drying the suspension to form a dried coating on the said portion that will prevent the adhesion of molten zinc to the said coated portion, galvanizing the uncoated portion of the article by dipping in a bath of molten zinc, and removing the coating from the article.

Preferably the suspension comprises from 6 to 15% by weight thereof of the talc.

BRIEF DESCRIPTION OF THE DRAWING

Particular preferred embodiments of the invention will now be described, by way of example, with reference to the FIGURE which illustrates a typical apparatus for use in the application of the processes of the invention.

DESCRIPTION OF THE PREFERRED EMBODIMENTS

The apparatus described is intended for use in the so-called Sendzimir system in which the ferrous strip is annealed just prior to dipping in the galvanizing bath. Accordingly, mill clean steel strip 10 at ambient temperature is fed from a pay-off reel 12 thereof through a looper assembly 13 and then beneath a series of spray nozzles 14 which apply to the upper surface of the strip a thin coating of an aqueous suspension of the hydrated form of magnesium silicate known as talc, the composition of which will be discussed in detail below. Although in this particular embodiment simple pressurized sprays of the liquid are employed, the coating can be applied by other means such as by rollers, or electrostatic spraying. The one-side coated strip continues beneath a drier 16 of any conventional type, by which the suspension is dried in ordinary ambient atmosphere, i.e. air, to a solid adherent coating. The strip then passes into a preheater 18 which heats the immediate surface of the strip to about 900° F. (482° C.) without appreciably heating the metal substrate and burns off the rolling oil and grease from the underside of the strip.

The strip continues into a sealed annealing furnace 20. The arrangement of the furnace 20 is not pertinent to this invention and is known to those skilled in the art; it will not therefore be discussed further, except to say that the entry part of the furnace is usually maintained at a temperature of about 1650°-1700° (900°-925° C.), while the exit part is usually maintained at a temperature sufficient to maintain the molten zinc at about 870° F., a reducing atmosphere of hydrogen and nitrogen being present. It will be apparent that the protective coating must remain coherent, zinc-impervious, and adherent under these conditions.

The strip exits from the annealing furnace through a closed snout-like passage 22 and dips into a galvanizing pot 24 under controlled atmospheric conditions, the pot containing molten zinc at the said temperature of about 870° F. (465° C.). The strip leaves the pot 24 and passes upward until the zinc coating has cooled and solidified sufficiently for the strip to pass safely over a tower roll 26, i.e. without damaging or marking the underneath galvanize coating in any way. After descending from the cooling tower and passing through an exit looper assembly 27 the upper surface is sprayed with water from nozzles 28 and the coating is brushed away, for example by one or more rotating brushes 30 extending across the width of the strip, until the coating is completely gone and the resulting one-side galvanized strip can be treated as required, e.g. re-oiled, and finally rolled onto a take-up reel 32.

The principal component of the suspension applied by the nozzles 16, after the water which is the liquid suspending vehicle, is of course the talc in finely-divided powder form, and this should be present in the range from 5 to 20% by weight of the suspension, preferably from 6 to 15%. If too little is present a sufficiently zinc-impervious coating is not formed and zinc will adhere to the desired zinc-free strip surface. If more than 20% is present a satisfactory aqueous suspension is difficult to achieve, since talc is inherently hydrophobic and difficult to wet. Talcs of average particle sizes 1.76; 2.37 and 4.65 microns have all been used in the production of successful coatings and the exact particle size does not appear to be particularly significant; powdered talcs of average particle size from about 1 to about 6 microns therefore are satisfactory, and the talcs referred to above are all readily commercially available.

It is found advantageous to include a bonding or etching agent in the suspension, i.e. an agent that will improve the bond between the dried coating and the metal strip. The lower carboxylic acids, acetic and formic acids are found to be very satisfactory for this purpose, preferably the lowest, namely formic acid (HCOOH), and this should be employed in the range 0.5 to 4% thereof by weight of the suspension, preferably from 1 to 2% by weight. 1.5% of acetic acid has been employed successfully. If less than the lowest amount specified is employed then of course no significant effect is noted. If too much is employed it appears to interfere with other agents employed in the suspension (to be described below), and also results in stains on the surface. As a general rule in the formulation of such suspensions all additions other than the talc should be kept to a minimum, since they constitute an impurity that may form a residue or react undesirably with the material of the ferrous strip to leave an unwanted stain.

A wetting agent is also employed in the suspension and by careful choice of material is able to perform the dual function of facilitating the wetting of the talc to promote its suspension, and acting as a spreading agent to spread the suspension over the strip surface while cutting through any residual oil and grease thereon. The material should be employed in the range of 0.5% to 5% by weight of the suspension, preferably 1.5 to 3%. A particularly suitable material is that sold under the trade mark AGRAL 90 by Chipman Chemical Co., consisting principally (about 90%) of a nonylphenyl ethylene oxide condensate. Another suitable material is a liquid detergent sold by H. L. Blatchford Ltd. of Montreal under the name "Quaker Solvoclean 77", approximately 5% by weight being employed.

It is also found advantageous to employ a thickening agent to facilitate the suspension of the talc and typically about 0.1 to 1% by weight is used. Such materials are relatively expensive and the minimum amount is therefore used. A very suitable material is Xanthan gum, a natural high molecular weight polysaccharide that functions as a hydrophilic colloid, as sold by Kelco Company under the trademark "Kelzan".

If foaming of the suspension occurs it will usually be necessary to add a defoamer, since the presence of foam bubbles in the suspension may result in clear spots in the coating, and the deposition of corresponding unwanted spots of zinc through these clear spots. A suitable material is for example that sold by Pennwalt Chemical Co., under trademark "BK" the minimum amount being used, since defoamers in general reduce the effectiveness of the wetting agent, the latter usually being the factor causing the foaming in the first instance.

A particular preferred suspension is obtained by the addition of about 0.1% of Kelzan thickener to the required qualtity of water followed by 10% of powdered talc. 1.5% of the bonding agent formic acid is then added followed by 2.0% of the wetting agent and sufficient of the defoamer to prevent a foam formation. The strip surface is flooded with the suspension and sufficient is found to remain in the surface to form a coherent coating about 2.5 mils thick upon drying with the dryer 16. In general, the thicker the resulting coating the less is the likelihood it will have small holes that will permit molten zinc to reach the underlying metal, but an upper limit is set mainly by the fact that as the thickness increases the flexibility of the coating is decreased and there is a tendency for it to flake off. The extent of the drying required at this stage is just sufficient to ensure that the more severe and rapid drying obtained in the annealing furnace will not crack and destroy the coating due to the sudden conversion of the suspending water to steam. A cold galvanizing line in which the metal strip is cleaned, coated with flux and then dipped in the molten zinc would require somewhat more drying by means of the dryer 16, in the absence of the furnace 20. The brush or brushes 30 can be a stiff bristle brush and will remove the wetted coating without marking of the clean steel surface.

What is claimed:

1. A method of galvanizing a portion only of a ferrous metal article, including the steps of:

applying to the portion of the article that is not to be galvanized a suspension comprising a liquid suspending vehicle consisting of water and from 5 to 20% by weight of the suspension of the hydrated form of magnesium silicate known as talc suspended in the water and drying the suspension to form a dried coating on the said portion that will prevent the adhesion of molten zinc to the said coated portion, galvanizing the uncoated portion of the article by dipping in a bath of molten zinc, and removng the coating from the article.

2. A method as claimed in claim 1, wherein the suspension includes from 6 to 15% by weight of talc.

3. A method as claimed in claim 1, wherein the suspension includes from 0.5 to 4% by weight of a bonding agent for bonding the material of the dried coating to the ferrous material of the article.

4. A method as claimed in claim 3, wherein the suspension includes from 1 to 2% by weight of the said bonding agent.

5. A method as claimed in claim 4, wherein the said bonding agent is selected from the group of formic and acetic acids.

6. A method as claimed in claim 4, wherein the said bonding agent is formic acid.

7. A method as claimed in claim 1, wherein the suspension includes from 0.5 to 5% by weight of a wetting agent for promotion of suspension of the powdered talc in the suspension and of spreading of the suspension over the coated portion of the surface of the article.

8. A method as claimed in claim 7, wherein the suspension includes from 1.5 to 3% by weight of said wetting agent.

9. A method as claimed in claim 1, wherein the suspension includes from 0.1 to 1% by weight of thickening agent to facilitate the suspension of the powdered talc in the suspension.

10. A method as claimed in claim 7, wherein the suspension includes a defoaming agent to counter any foam-producing effect of the wetting agent.

11. A method as claimed in claim 1, wherein the talc is in powder form of average particle size about 1 to 6 microns.

12. A method as claimed in claim 1, wherein the suspension includes from 0.5 to 4% by weight of a bonding agent for bonding the material of the dried coating to the ferrous material of the article and from 0.5 to 5% by weight of a wetting agent for promotion of suspension of the powdered talc in the suspension and of spreading of the suspension over the coated portion of the surface of the article.

13. A method as claimed in claim 1 wherein the suspension includes from 0.5 to 4% by weight of a bonding agent for bonding the material of the dried coating to the ferrous material of the article, from 0.5 to 5% by weight of a wetting agent for promotion of suspension of the powdered talc in the suspension and of spreading of the suspension over the coated portion of the surface of the article and from 0.1 to 1% by weight of thickening agent to facilitate the suspension of the powdered talc in the suspension.

14. A method as claimed in claim 1 wherein the suspension incudes from 0.5 to 4% by weight of a bonding agent for bonding the material of the dried coating to the ferrous material of the article, from 0.5 to 5% by weight of a wetting agent for promotion of suspension of the powdered talc in the suspension and of spreading of the suspension over the coated portion of the surface of the article, from 0.1 to 1% by weight of thickening agent to facilitate the suspension of the powdered talc in the suspension, and a defoaming agent to counter any foam-producing effect of the wetting agent.

15. A method as claimed in claim 1, wherein the suspension includes from 9.5 to 4% by weight of a bonding agent for bonding the material of the dried coating to the ferrous material of the article, from 0.5 to 5% by weight of a wetting agent for promotion of suspension of the powdered talc in the suspension and of spreading of the suspension over the coated portion of the surface of the article, from 0.1 to 1% by weight of thickening agent to facilitate the suspension of the powdered talc in the suspension, and a defoaming agent to counter any foam-producing effect of the wetting agent, and wherein the talc is in powder form of average particle size about 1 to 6 microns.

16. A method as claimed in claim 1, wherein the suspension includes from 0.5 to 4% by weight of formic acid as a bonding agent for bonding the material of the dried coating to the ferrous material of the article.

17. A method as claimed in claim 2, wherein the suspension includes from 1 to 2% by weight of formic acid as a bonding agent for bonding the material of the dried coating to the ferrous material of the article.

18. A method as claimed in claim 1, wherein the suspension includes from 0.5 to 4% by weight of formic acid as a bonding agent for bonding the material of the dried coating to the ferrous material of the article and from 0.5 to 5% by weight of a wetting agent for promotion of suspension of the powdered talc in the suspension and of spreading of the suspension over the coated portion of the surface of the article.

19. A method as claimed in claim 2, wherein the suspension includes from 1 to 2% by weight of formic acid as a bonding agent for bonding the material of the dried coating to the ferrous material of the article and from 1.5 to 3% by weight of wetting agent for promotion of suspension of the powdered talc in the suspension and of spreading of the suspension over the coated portion of the surface of the article.

20. A method as claimed in claim 1, wherein the suspension includes from 0.5 to 4% by weight of formic acid as a bonding agent for bonding the material of the dried coating to the ferrous material of the article, from 0.5 to 5% by weight of a wetting agent for promotion of suspension of the powdered talc in the suspension and of spreading of the suspension over the coated portion of the surface of the article, and from 0.1 to 1% by weight of thickening agent to facilitate the suspension of the powdered talc in the suspension.

21. A method as claimed in claim 1, wherein the suspension includes from 6 to 15% by weight of talc, from 1 to 2% by weight of formic acid as a bonding agent for bonding the material of the dried coating to the ferrous material of the article, from 1.5 to 3% by weight of wetting agent for promotion of suspension of the powdered talc in the suspension and of spreading of the suspension over the coated portion of the surface of the article, and from 0.1 to 1% by weight of thickening agent to facilitate the suspension of the powdered talc in the suspension.

22. A method as claimed in claim 2, wherein the suspension includes from 1 to 2% by weight of a bondng agent selected from the group of acetic and formic acids for bonding the material of the dried coating to the ferrous material of the article, and from 1.5 to 3% by weight of wetting agent for promotion of suspension of the powdered talc in the suspension and of spreading of the suspension over the coated portion of the surface of the article.

23. A method as claimed in claim 2, wherein the suspension includes from 1 to 2% by weight of a bonding agent selected from the group of acetic and formic acids for bonding the material of the dried coating to the ferrous material of the article, from 1.5 to 3% by weight of wetting agent for promotion of suspension of the powdered talc in the suspension and of spreading of the suspension over the coated portion of the surface of the article, and from 0.1 to 1% by weight of thickening agent to facilitate the suspension of the powdered talc in the suspension.

24. A method as claimed in claim 2, wherein the suspension includes from 1 to 2% by weight of a bonding agent selected from the group of acetic and formic acids for bonding the material of the dried coating to the ferrous material of the article, from 1.5 to 3% by weight of wetting agent for promotion of suspension of the powdered talc in the suspension and of spreading of the suspension over the coated portion of the surface of the article, from 0.1 to 1% by weight of thickening agent to facilitate the suspension of the powdered talc in the suspension, and a defoaming agent to counter any foam-producing effec of the wetting agent.

25. A method as claimed in claim 1, wherein the suspension is dried in air.

* * * * *